US009125285B2

(12) United States Patent
Umeda

(10) Patent No.: US 9,125,285 B2
(45) Date of Patent: Sep. 1, 2015

(54) TARGET SUPPLY DEVICE AND EUV LIGHT GENERATION CHAMBER

(71) Applicant: GIGAPHOTON INC., Oyama-shi, Tochigi (JP)

(72) Inventor: Hiroshi Umeda, Oyama (JP)

(73) Assignee: GIGAPHOTON INC., Tochigi (JP)

( * ) Notice: Subject to any disclaimer, the term of this patent is extended or adjusted under 35 U.S.C. 154(b) by 0 days.

(21) Appl. No.: 14/159,909

(22) Filed: Jan. 21, 2014

(65) Prior Publication Data

US 2014/0209819 A1 Jul. 31, 2014

(30) Foreign Application Priority Data

Jan. 25, 2013 (JP) ..... 2013-012320

(51) Int. Cl.
*H05G 2/00* (2006.01)

(52) U.S. Cl.
CPC ..... *H05G 2/008* (2013.01); *H05G 2/005* (2013.01); *H05G 2/006* (2013.01)

(58) Field of Classification Search
CPC ..... H05G 2/006; H05G 2/008; H05G 2/005
USPC ..... 250/504 R
See application file for complete search history.

(56) References Cited

U.S. PATENT DOCUMENTS

| | | | | |
|---|---|---|---|---|
| 7,405,416 | B2 | 7/2008 | Algots et al. | |
| 8,710,472 | B2 * | 4/2014 | Ishihara et al. | 250/504 R |
| 2007/0228301 | A1 * | 10/2007 | Nakano | 250/504 R |
| 2011/0101863 | A1 * | 5/2011 | Komori et al. | 315/111.41 |
| 2012/0085922 | A1 * | 4/2012 | Yabu et al. | 250/432 R |
| 2012/0104289 | A1 * | 5/2012 | Mizoguchi et al. | 250/504 R |
| 2012/0241650 | A1 * | 9/2012 | Yabu et al. | 250/504 R |
| 2013/0284949 | A1 * | 10/2013 | Komori et al. | 250/504 R |

* cited by examiner

*Primary Examiner* — Nicole Ippolito
*Assistant Examiner* — Wyatt Stoffa
(74) *Attorney, Agent, or Firm* — McDermott Will & Emery LLP

(57) ABSTRACT

A target supply device may include a tank including a nozzle, a first electrode disposed within the tank, a first potential setting unit configured to set a potential at the first electrode to a first potential, a second electrode provided with a first through-hole and disposed so that a center axis of the nozzle is positioned within the first through-hole, a second potential setting unit configured to set a potential at the second electrode to a second potential that is different from the first potential, and a charge neutralization unit configured to neutralize a charge of the target material that passes through a first region located between the second electrode and the plasma generation region.

11 Claims, 10 Drawing Sheets

TARGET SUPPLY DEVICE AND EUV LIGHT GENERATION CHAMBER

CROSS-REFERENCE TO A RELATED APPLICATION

The present application claims priority from Japanese Patent Application No. 2013-012320 filed Jan. 25, 2013.

BACKGROUND

1. Technical Field

The present disclosure relates to target supply devices and EUV light generation chambers.

2. Related Art

In recent years, semiconductor production processes have become capable of producing semiconductor devices with increasingly fine feature sizes, as photolithography has been making rapid progress toward finer fabrication. In the next generation of semiconductor production processes, microfabrication with feature sizes at 60 nm to 45 nm, and further, microfabrication with feature sizes of 32 nm or less will be required. In order to meet the demand for microfabrication with feature sizes of 32 nm or less, for example, an exposure apparatus is needed in which a system for generating EUV light at a wavelength of approximately 13 nm is combined with a reduced projection reflective optical system.

Three kinds of systems for generating EUV light are known in general, which include a Laser Produced Plasma (LPP) type system in which plasma is generated by irradiating a target material with a laser beam, a Discharge Produced Plasma (DPP) type system in which plasma is generated by electric discharge, and a Synchrotron Radiation (SR) type system in which orbital radiation is used to generate plasma.

SUMMARY

A target supply device according to an aspect of the present disclosure may be a target supply device that supplies a target material to a plasma generation region, and may include a tank, a first electrode, a first potential setting unit, a second electrode, a second potential setting unit, and a charge neutralization unit. The tank may include a nozzle. The first electrode may be disposed within the tank. The first potential setting unit may be configured to set a potential at the first electrode to a first potential. The second electrode may be provided with a first through-hole and disposed so that a center axis of the nozzle is positioned within the first through-hole. The second potential setting unit may be configured to set a potential at the second electrode to a second potential that is different from the first potential. The charge neutralization unit may neutralize a charge of the target material that passes through a first region located between the second electrode and the plasma generation region.

An EUV light generation chamber according to an aspect of the present disclosure may be an EUV light generation chamber for irradiating a target material supplied to a plasma generation region with a laser beam, and may include a chamber, a tank, a first electrode, a second electrode, and a charge neutralization unit. The chamber may include an introduction hole that introduces the laser beam. The tank may include a nozzle and may be anchored to the chamber so that the nozzle is positioned within the chamber. The first electrode may be disposed within the tank. The second electrode may be provided with a first through-hole and disposed so that a center axis of the nozzle is positioned within the first through-hole. The charge neutralization unit may neutralize a charge of the target material that passes through a first region located between the second electrode and the plasma generation region.

BRIEF DESCRIPTION OF THE DRAWINGS

Hereinafter, selected embodiments of the present disclosure will be described with reference to the accompanying drawings.

DETAILED DESCRIPTION

Figure 1:
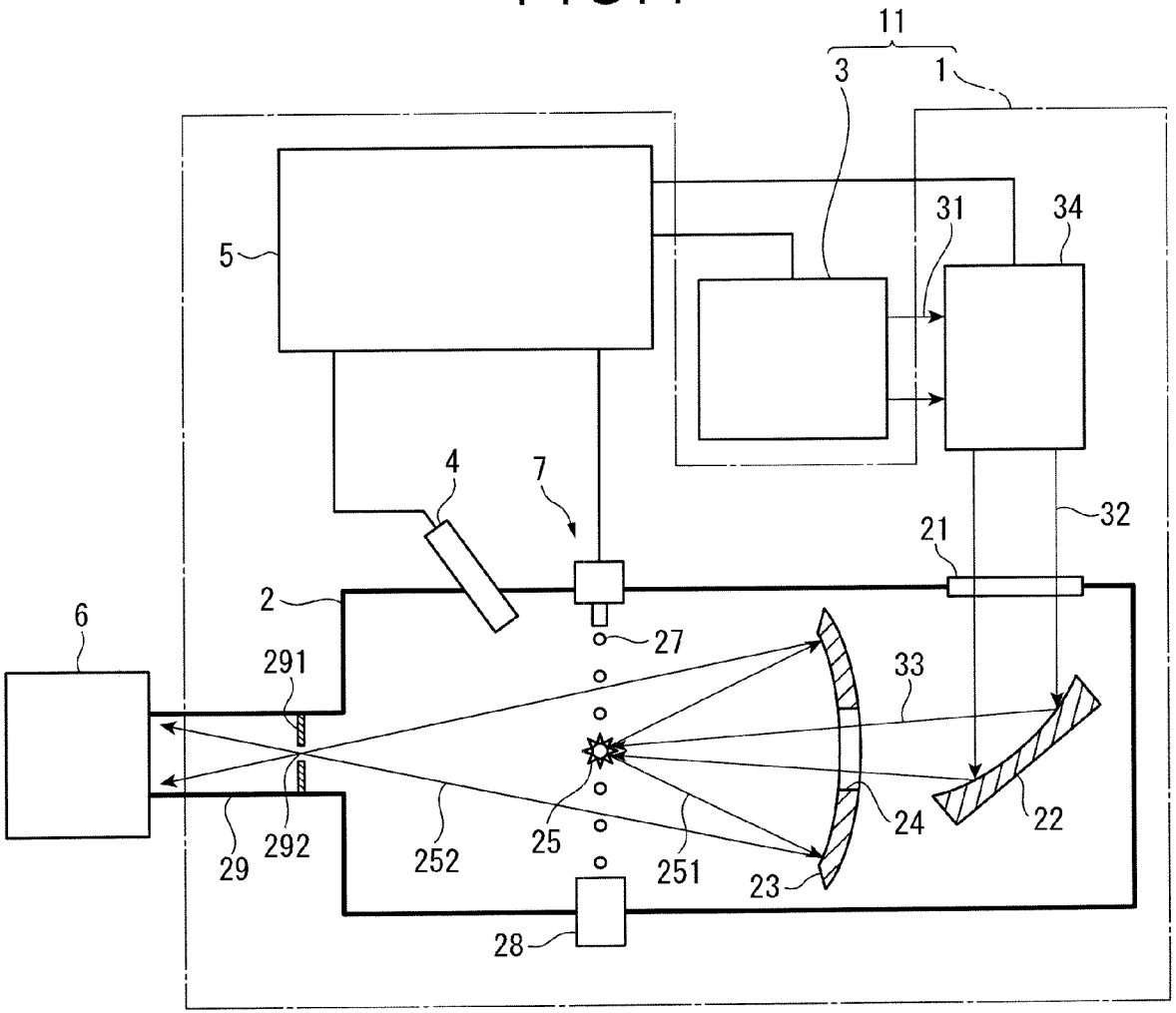
FIG. 1 schematically illustrates an exemplary configuration of an EUV light generation apparatus.

Hereinafter, selected embodiments of the present disclosure will be described in detail with reference to the accompanying drawings. The embodiments to be described below are merely illustrative in nature and do not limit the scope of the present disclosure. Further, the configuration(s) and operation(s) described in each embodiment are not all essential in implementing the present disclosure. Note that like elements are referenced by like reference numerals and characters, and duplicate descriptions thereof will be omitted herein.

Contents

1. Overview
2. Overall Description of EUV Light Generation Apparatus
2.1 Configuration
2.2 Operation
3. EUV Light Generation Apparatus Including Target Supply Device
3.1 Terms
3.2 First Embodiment
3.2.1 Overview
3.2.2 Configuration
3.2.3 Operation
3.3 Second Embodiment
3.3.1 Overview
3.3.2 Configuration
3.3.3 Operation
3.4 Third Embodiment
3.4.1 Overview
3.4.2 Configuration
3.4.3 Operation
3.5 Fourth Embodiment
3.5.1 Overview 3.5.2 Configuration
3.5.3 Operation
3.6 Fifth Embodiment
3.6.1 Overview
3.6.2 Configuration
3.6.3 Operation
3.7 Sixth Embodiment
3.7.1 Overview
3.7.2 Configuration
3.7.3 Operation
3.8 Seventh Embodiment
3.8.1 Configuration
3.9 Eighth Embodiment
3.9.1 Configuration
3.9.2 Operation
3.10 Variations 1. Overview A target supply device according to an embodiment of the present disclosure may be a target supply device that supplies a target material to a plasma generation region, and may include a tank, a first electrode, a first potential setting unit, a second electrode, a second potential setting unit, and a charge neutralization unit. The tank may include a nozzle. The first electrode may be disposed within the tank. The first potential setting unit may be configured to set a potential at the first electrode to a first potential. The second electrode may be provided with a first through-hole and disposed so that a center axis of the nozzle is positioned within the first through-hole. The second potential setting unit may be configured to set a potential at the second electrode to a second potential that is different from the first potential. The charge neutralization unit may neutralize a charge of the target material that passes through a first region located between the second electrode and the plasma generation region.

An EUV light generation chamber according to an embodiment of the present disclosure may be an EUV light generation chamber for irradiating a target material supplied to a plasma generation region with a laser beam, and may include a chamber, a tank, a first electrode, a second electrode, and a charge neutralization unit. The chamber may include an introduction hole that introduces the laser beam. The tank may include a nozzle and may be anchored to the chamber so that the nozzle is positioned within the chamber. The first electrode may be disposed within the tank. The second electrode may be provided with a first through-hole and disposed so that a center axis of the nozzle is positioned within the first through-hole. The charge neutralization unit may neutralize a charge of the target material that passes through a first region located between the second electrode and the plasma generation region.

2. Overall Description of EUV Light Generation Apparatus 2.1 Configuration

FIG. 1 schematically illustrates an exemplary configuration of an LPP type EUV light generation system. An EUV light generation apparatus 1 may be used with at least one laser apparatus 3. Hereinafter, a system that includes the EUV light generation apparatus 1 and the laser apparatus 3 may be referred to as an EUV light generation system 11. As shown in FIG. 1 and described in detail below, the EUV light generation system 11 may include a chamber 2 and a target supply device 7. The chamber 2 may be sealed airtight. The target supply device 7 may be mounted onto the chamber 2, for example, to penetrate a wall of the chamber 2. A target material to be supplied by the target supply device 7 may include, but is not limited to, tin, terbium, gadolinium, lithium, xenon, or any combination thereof.

The chamber 2 may have at least one through-hole or opening formed in its wall, and a pulse laser beam 32 may travel through the through-hole/opening into the chamber 2. Alternatively, the chamber 2 may have a window 21, through which the pulse laser beam 32 may travel into the chamber 2. An EUV collector mirror 23 having a spheroidal surface may, for example, be provided in the chamber 2. The EUV collector mirror 23 may have a multi-layered reflective film formed on the spheroidal surface thereof. The reflective film may include a molybdenum layer and a silicon layer, which are alternately laminated. The EUV collector mirror 23 may have a first focus and a second focus, and may be positioned such that the first focus lies in a plasma generation region 25 and the second focus lies in an intermediate focus (IF) region 292 defined by the specifications of an external apparatus, such as an exposure apparatus 6. The EUV collector mirror 23 may have a through-hole 24 formed at the center thereof so that a pulse laser beam 33 may travel through the through-hole 24 toward the plasma generation region 25.

The EUV light generation system 11 may further include an EUV light generation controller 5 and a target sensor 4. The target sensor 4 may have an imaging function and detect at least one of the presence, trajectory, position, and speed of a target 27.

Further, the EUV light generation system 11 may include a connection part 29 for allowing the interior of the chamber 2 to be in communication with the interior of the exposure apparatus 6. A wall 291 having an aperture 293 may be provided in the connection part 29. The wall 291 may be positioned such that the second focus of the EUV collector mirror 23 lies in the aperture 293 formed in the wall 291.

The EUV light generation system 11 may also include a laser beam direction control unit 34, a laser beam focusing mirror 22, and a target collector 28 for collecting targets 27. The laser beam direction control unit 34 may include an optical element (not separately shown) for defining the direction into which the pulse laser beam 32 travels and an actuator (not separately shown) for adjusting the position and the orientation or posture of the optical element.

2.2 Operation

With continued reference to FIG. 1, a pulse laser beam 31 outputted from the laser apparatus 3 may pass through the laser beam direction control unit 34 and be outputted therefrom as the pulse laser beam 32 after having its direction optionally adjusted. The pulse laser beam 32 may travel through the window 21 and enter the chamber 2. The pulse laser beam 32 may travel inside the chamber 2 along at least one beam path from the laser apparatus 3, be reflected by the laser beam focusing mirror 22, and strike at least one target 27 as a pulse laser beam 33.

The target supply device 7 may be configured to output the target(s) 27 toward the plasma generation region 25 in the chamber 2. The target 27 may be irradiated with at least one pulse of the pulse laser beam 33. Upon being irradiated with the pulse laser beam 33, the target 27 may be turned into plasma, and rays of light 251 including EUV light may be emitted from the plasma. At least the EUV light included in the light 251 may be reflected selectively by the EUV collector mirror 23. EUV light 252, which is the light reflected by the EUV collector mirror 23, may travel through the intermediate focus region 292 and be outputted to the exposure apparatus 6. Here, the target 27 may be irradiated with multiple pulses included in the pulse laser beam 33.

The EUV light generation controller 5 may be configured to integrally control the EUV light generation system 11. The EUV light generation controller 5 may be configured to process image data of the target 27 captured by the target sensor 4. Further, the EUV light generation controller 5 may be configured to control at least one of: the timing when the target 27 is outputted and the direction into which the target 27 is outputted. Furthermore, the EUV light generation controller 5 may be configured to control at least one of: the timing when the laser apparatus 3 oscillates, the direction in which the pulse laser beam 33 travels, and the position at which the pulse laser beam 33 is focused. It will be appreciated that the various controls mentioned above are merely examples, and other controls may be added as necessary.

3. EUV Light Generation Apparatus Including Target Supply Device 3.1 Terms

Hereinafter, aside from descriptions that refer to FIG. 1, there are cases where directions will be described based on XYZ axes illustrated in the drawings. Note that these expressions do not express relationships with a gravitational direction 10B.

3.2 First Embodiment 3.2.1 Overview

In a target supply device according to a first embodiment of the present disclosure, the charge neutralization unit may include a thermoelectron emitting unit that emits thermoelectrons in the first region, and a thermoelectron collecting unit, disposed opposing the thermoelectron emitting unit with the center axis of the nozzle between the thermoelectron collecting unit and the thermoelectron emitting unit, that collects the thermoelectrons.

3.2.2 Configuration

Figure 2:
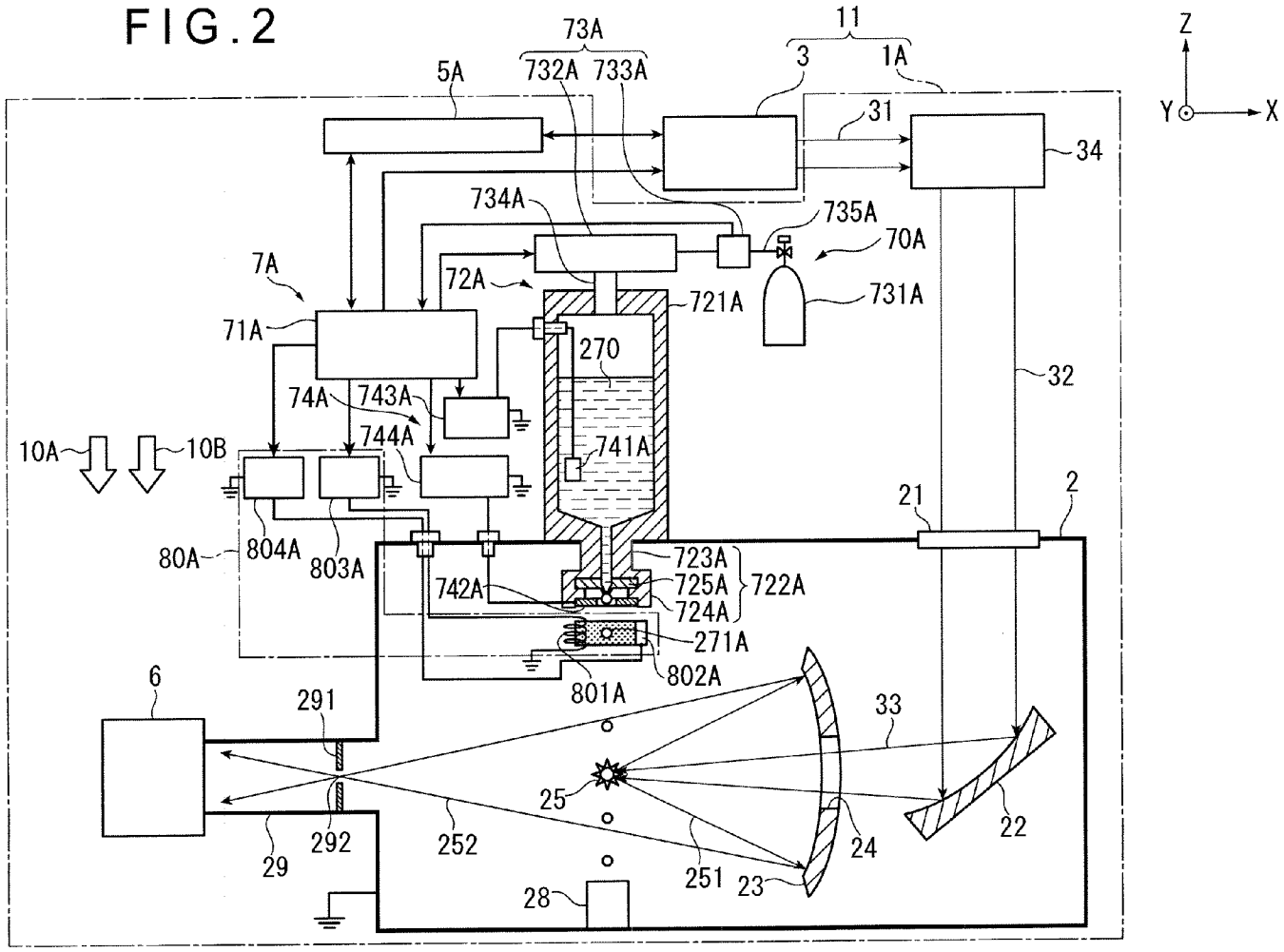
FIG. 2 schematically illustrates the configuration of an EUV light generation apparatus that includes a target supply device according to a first embodiment.
Figure 3:
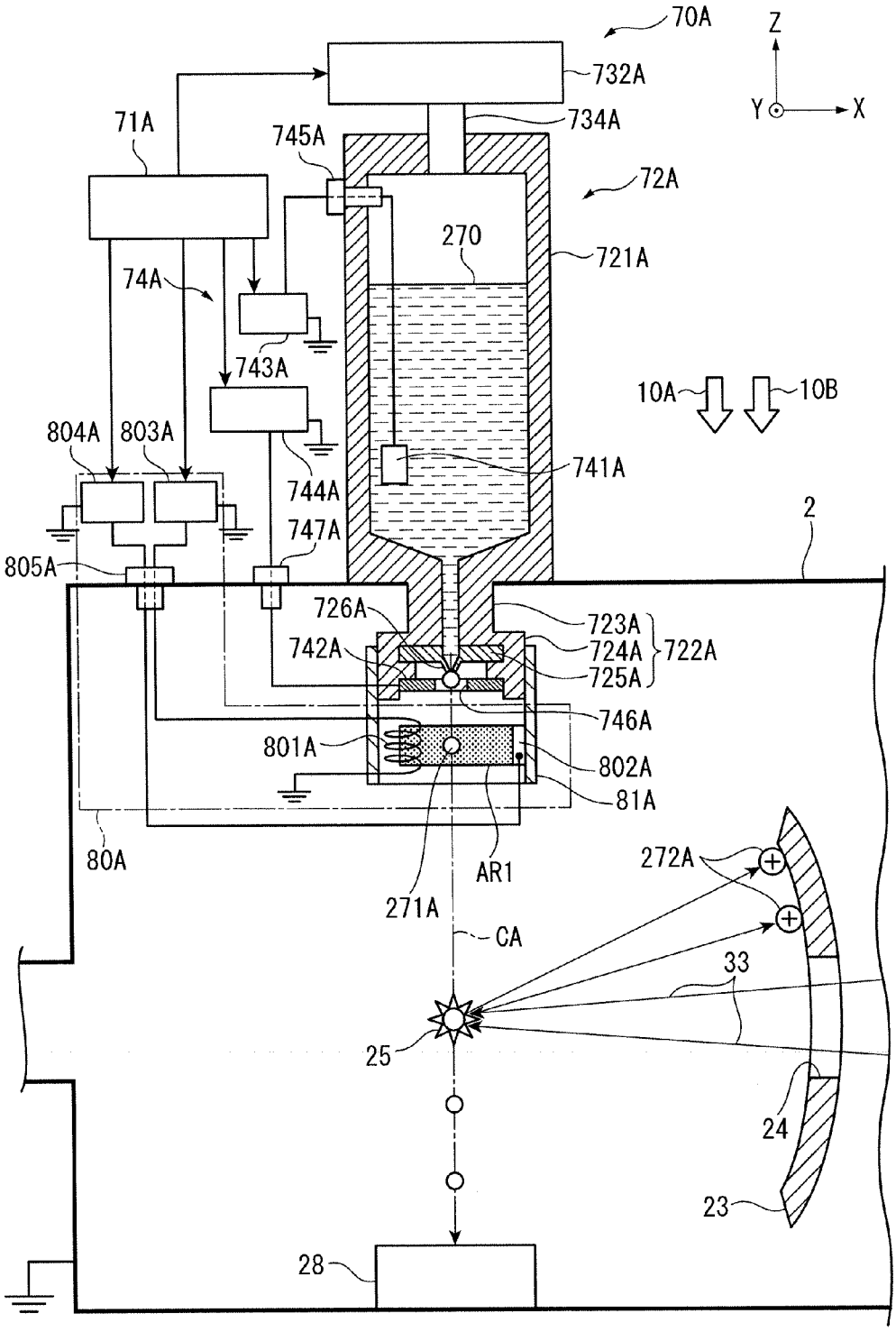
FIG. 3 schematically illustrates the configuration of the target supply device according to the first embodiment.

FIG. 2 schematically illustrates the configuration of an EUV light generation apparatus that includes the target supply device according to the first embodiment. FIG. 3 schematically illustrates the configuration of the target supply device according to the first embodiment.

An EUV light generation apparatus 1A may, as shown in FIG. 2, include the chamber 2 and a target supply device 7A. The target supply device 7A may include a target generation section 70A and a target control apparatus 71A. The chamber 2 may be grounded. The laser apparatus 3 and an EUV light generation controller 5A may be electrically connected to the target control apparatus 71A.

As shown in FIGS. 2 and 3, the target generation section 70A may include a target generator 72A, a pressure control section 73A, an electrostatic extraction section 74A, a charge neutralization section 80A, a holder portion 81A, and a temperature control section (not shown).

The target generator 72A may include a tank 721A for holding a target material 270 in its interior. The tank 721A may be cylindrical in shape. A nozzle 722A for outputting the target material 270 in the tank 721A to the chamber 2 as targets 271A may be provided in the tank 721A. The target generator 72A may be provided so that the tank 721A is positioned outside the chamber 2 and the nozzle 722A is positioned inside the chamber 2. The pressure control section 73A may be linked to the tank 721A.

Assuming a pre-set output direction of the targets 271A is taken as a set output direction 10A, depending on how the chamber 2 is arranged, it is not necessarily the case that the set output direction 10A will match the gravitational direction 10B. The configuration may be such that the targets 271A are outputted horizontally or at an angle relative to the gravitational direction 10B. Note that the first through eighth embodiments illustrate cases where the chamber 2 is arranged so that the set output direction 10A of the targets 271A is at an angle relative to the gravitational direction 10B.

The nozzle 722A may include a nozzle main body 723A, a holding portion 724A, and an output portion 725A. The nozzle main body 723A may be provided so as to protrude into the chamber 2 from a second end portion on the −Z direction side of the tank 721A. The holding portion 724A may be provided on the leading end of the nozzle main body 723A. The holding portion 724A may be formed as a cylinder whose diameter is greater than the diameter of the nozzle main body 723A.

The output portion 725A may be formed as an approximately circular plate. The output portion 725A may be held by the holding portion 724A so as to be tightly affixed to an end surface on the −Z direction side of the nozzle main body 723A. A circular truncated-cone-shaped protruding portion 726A may be provided in a central area of the output portion 725A. The output portion 725A may be provided so that the protruding portion 726A protrudes into the chamber 2. The protruding portion 726A may be provided so as to make it easier for an electrical field to concentrate thereon. A nozzle hole may be provided in the protruding portion 726A, in approximately the center of a leading end portion that configures an upper surface area of the circular truncated-cone-shape of the protruding portion 726A. The diameter of the nozzle hole may be 6 to 15 μm. At least the part of the output portion 725A that makes contact with the target material 270 may be configured of a material having a low wettability with respect to the target material 270. For example, it is preferable for the output portion 725A to be configured of a material that achieves an angle of contact of greater than or equal to 90° between the output portion 725A and the target material 270. Alternatively, at least the surface of the output portion 725A may be coated with a material whose stated angle of contact is greater than or equal to 90°. The material having an angle of contact greater than or equal to 90° may be one of SiC, $SiO_2$, $Al_2O_2$, molybdenum, and tungsten.

The tank 721A, the nozzle 722A, and the output portion 725A may be configured of electrically insulated materials. In the case where these elements are configured of materials that are not electrically insulated materials, for example, metal materials such as molybdenum, an electrically insulated material may be disposed between the chamber 2 and the target generator 72A, between the output portion 725A and a second electrode 742A (mentioned later), and so on. In this case, the tank 721A and a pulse voltage generator 744A, mentioned later, may be electrically connected.

The pressure control section 73A may include an actuator 732A and a pressure sensor 733A. The actuator 732A may be linked to a first end portion of the tank 721A on the +Z direction side thereof via a pipe 734A. The actuator 732A may be connected to an inert gas bottle 731A via a pipe 735A. The actuator 732A may be electrically connected to the target control apparatus 71A. The actuator 732A may be configured to adjust a pressure within the tank 721A by controlling the pressure of an inert gas supplied from the inert gas bottle 731A based on a signal sent from the target control apparatus 71A.

The pressure sensor 733A may be provided in the pipe 735A. The pressure sensor 733A may be electrically connected to the target control apparatus 71A. The pressure sensor 733A may detect a pressure of the inert gas present in the pipe 735A and may send a signal corresponding to the detected pressure to the target control apparatus 71A.

The electrostatic extraction section 74A may include a first electrode 741A, the second electrode 742A, a voltage source 743A, and the pulse voltage generator 744A. As will be described later, the targets 271A may be extracted from the output portion 725A by utilizing a potential difference between a first potential applied to the first electrode 741A and a second potential applied to the second electrode 742A.

The first electrode 741A may be disposed in the target material 270 within the tank 721A. The voltage source 743A may be electrically connected to the first electrode 741A via a feedthrough 745A.

The second electrode 742A may be formed as an approximately circular plate. A circular first through-hole 746A may be formed in the center of the second electrode 742A. The second electrode 742A may be anchored to the holding portion 724A. At this time, the second electrode 742A may face the output portion 725A at a position distanced from the output portion 725A by a predetermined distance. A center axis of the nozzle 722A may be positioned within the first through-hole 746A. The pulse voltage generator 744A may be electrically connected to the second electrode 742A via a feedthrough 747A.

The voltage source 743A may serve as a first potential setting unit according to the present disclosure.

The pulse voltage generator 744A may serve as a second potential setting unit according to the present disclosure.

The device grounds of the voltage source 743A and the pulse voltage generator 744A may be grounded. The target control apparatus 71A may be electrically connected to the voltage source 743A and the pulse voltage generator 744A.

The charge neutralization section 80A may include a thermoelectron emitting portion 801A, a thermoelectron collecting portion 802A, a power source 803A, and a power source 804A.

The thermoelectron emitting portion 801A may be a filament configured of tungsten. The power source 803A may be electrically connected to a first end portion of the thermoelectron emitting portion 801A via a feedthrough 805A. A second end portion of the thermoelectron emitting portion 801A may be grounded.

The thermoelectron collecting portion 802A may be formed of a conductive material. The power source 804A may be electrically connected to the thermoelectron collecting portion 802A via the feedthrough 805A.

The device grounds of the power source 803A and the power source 804A may be grounded. The target control apparatus 71A may be electrically connected to the power source 803A and the power source 804A.

The holder portion 81A may be formed of an insulative material in an approximately cylindrical shape. An inner diameter of the holder portion 81A may be substantially the same as an outer diameter of the holding portion 724A. A dimension of the holder portion 81A in an axial direction thereof may be greater than a dimension of the holding portion 724A in an axial direction thereof.

The holder portion 81A may be anchored to the holding portion 724A so that the holding portion 724A is fitted into the interior of the holder portion 81A. A second end portion of the holder portion 81A on the −Z direction side thereof may be positioned further on the −Z direction side than a second end portion on the −Z direction side of the holding portion 724A.

The thermoelectron emitting portion 801A and the thermoelectron collecting portion 802A may be anchored to an inner side of the holder portion 81A. The thermoelectron emitting portion 801A may oppose the thermoelectron collecting portion 802A with a center axis of the nozzle 722A therebetween.

According to this configuration, the thermoelectron emitting portion 801A and the thermoelectron collecting portion 802A can be anchored so as to be located between the second electrode 742A and the plasma generation region 25 on the −Z direction side of the nozzle 722A.

The temperature control section may be configured to control the temperature of the target material 270 within the tank 721A. For example, the temperature control section may include a heater positioned on an outer circumferential area of the tank 721A, a power source that supplies power to the heater, a temperature sensor that detects a temperature of the tank 721A, and a temperature control unit that controls the supply of power by the power source by taking a result of the detection performed by the temperature sensor as an input.

The target control apparatus 71A may control the temperature of the target material 270 in the target generator 72A by sending a signal to the temperature control section. Through this, the target control apparatus 71A may keep the target material 270 in a liquid state. The target control apparatus 71A may control a pressure in the target generator 72A by sending a signal to the actuator 732A of the pressure control section 73A. The target control apparatus 71A may control the potentials applied to the first electrode 741A and the second electrode 742A by sending signals to the voltage source 743A and the pulse voltage generator 744A, respectively. The target control apparatus 71A may control potentials applied to the thermoelectron emitting portion 801A and the thermoelectron collecting portion 802A by sending signals to the power source 803A and the power source 804A, respectively.

3.2.3 Operation

Figure 4:
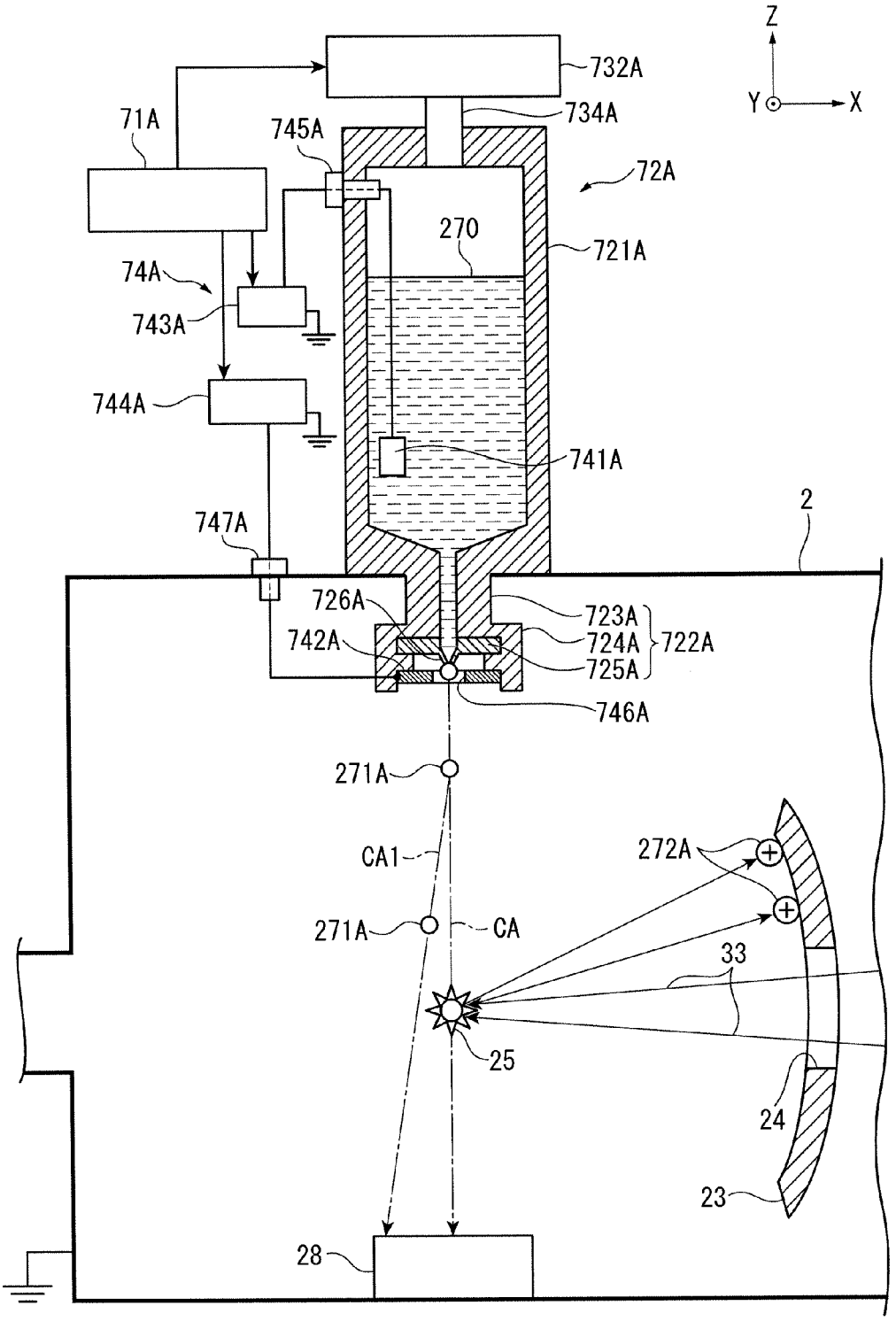
FIG. 4 is a diagram illustrating a phenomenon in which a trajectory of targets shifts, and illustrates a state in which a target supply device is outputting targets.

FIG. 4 is a diagram illustrating a phenomenon in which a trajectory of the targets shifts, and illustrates a state in which the target supply device is outputting targets.

Note that the following describes operations performed by the target supply device 7A using a case where the target material 270 is tin as an example.

The configuration of the target supply device may, as shown in FIG. 4, be the same as that of the EUV light generation apparatus 1A according to the first embodiment, with the exception of the charge neutralization section 80A and the holder portion 81A.

In this target supply device, the target control apparatus 71A may heat the target material 270 within the target generator 72A to a predetermined temperature greater than or equal to the melting point of the target material 270 by sending a signal to the temperature control section. The target control apparatus 71A may apply the positive first potential to the target material 270 within the target generator 72A by sending a signal to the voltage source 743A. The target control apparatus 71A may apply the positive first potential to the second electrode 742A by sending a signal to the pulse voltage generator 744A. The first potential may be 50 kV, for example.

Then, while the first potential is applied to the target material 270, the target control apparatus 71A may cause the potential applied to the second electrode 742A to drop from the first potential to the second potential by sending a signal to the pulse voltage generator 744A, hold the second potential for a predetermined amount of time, and once again return the potential to the first potential. The second potential may be 45 kV, for example. At this time, the target material 270 can be extracted in a shape of a droplet using static electricity in synchronization with the timing at which the potential at the second electrode 742A drops. Because the second potential at the second electrode 742A is lower than the first potential at the first electrode 741A, the target 271A is positively charged and can pass through the first through-hole 746A of the second electrode 742A. The target 271A that has passed through the first through-hole 746A can be irradiated with the pulse laser beam 33 upon reaching the plasma generation region 25.

The target 271A irradiated with the pulse laser beam 33 is turned into plasma, and EUV light is radiated from the plasma.

Here, when the target material 270 in the target generator 72A is extracted from the nozzle 722A in a shape of a droplet, the trajectory of the target 271A may shift from a set trajectory CA toward a direction approximately orthogonal to the set trajectory CA (that is, a direction approximately orthogonal to a Z-axis direction). A reason why the trajectory of the target 271A shifts from the set trajectory CA can be postulated as follows.

When the target material 270 is turned into plasma, ions 272A and electrons of the target material 270 can be emitted from the plasma. If the ions 272A adhere to an electrical insulation member disposed within the chamber 2, members that are not grounded, or the like, the areas to which the ions 272A have adhered can become positively charged. The potential can increase in the vicinity of the positively-charged areas, and a potential distribution along the set trajectory CA of the target 271A can change.

For example, if the ions 272A adhere to the EUV collector mirror 23, which is not grounded, the areas where the ions 272A have adhered can become positively charged, and the potential distribution along the set trajectory CA can change in the vicinity of the EUV collector mirror 23. In the case where the target 271A is positively charged, the polarity of the target 271A and the polarity of the EUV collector mirror 23 will be the same, and thus a repulsive force can arise between the two. A trajectory CA1 of the target 271A can thus shift in the −X direction from the set trajectory CA as a result.

To suppress the phenomenon described using FIG. 4, the charge neutralization section 80A and the holder portion 81A may be provided in the target supply device 7A as shown in FIG. 3.

In the target supply device 7A shown in FIG. 3, the target control apparatus 71A may apply positive potentials to the thermoelectron emitting portion 801A and the thermoelectron collecting portion 802A, respectively, by sending signals to the power source 803A and the power source 804A, respectively. The potential applied to the thermoelectron emitting portion 801A may be a potential at which thermoelectrons are emitted from the thermoelectron emitting portion 801A. The potential applied to the thermoelectron collecting portion 802A may be a potential at which the thermoelectrons emitted from the thermoelectron emitting portion 801A can be collected. The potential applied to the thermoelectron collecting portion 802A may be a potential at which a repulsive force that shifts the trajectory of the targets 271A does not arise between the thermoelectron collecting portion 802A and the targets 271A. The potential applied to the thermoelectron collecting portion 802A may be greater than or equal to 10 V and less than or equal to 100 V, for example.

When the potentials are applied to the thermoelectron emitting portion 801A and the thermoelectron collecting portion 802A, thermoelectrons can move toward the thermoelectron collecting portion 802A in a first region AR1 between the thermoelectron emitting portion 801A and the thermoelectron collecting portion 802A. When the positively-charged target 271A enters the first region AR1, the target 271A can be irradiated with thermoelectrons. As a result, the charge of the target 271A can be neutralized and the charge amount of the target 271A can be reduced. In this manner, the first region AR1 may act as a region that reduces the charge amount of the charged target 271A.

In the case where the potential distribution along the set trajectory CA has changed under the influence of the ions 272A that have adhered to the EUV collector mirror 23, the repulsive force arising between the target 271A and the EUV collector mirror 23 can become lower than in the case illustrated in FIG. 4. The trajectory of the target 271A can thus be suppressed from shifting from the set trajectory CA as a result.

3.3 Second Embodiment 3.3.1 Overview

A target supply device according to a second embodiment of the present disclosure may further include a third electrode provided with a second through-hole and disposed between the second electrode and the first region so that the center axis of the nozzle is positioned within the second through-hole, and a third potential setting unit configured to set a potential at the third electrode to a third potential that is different from the first potential and the second potential; and the second potential may be greater than the first potential and less than the third potential.

3.3.2 Configuration

Figure 5:
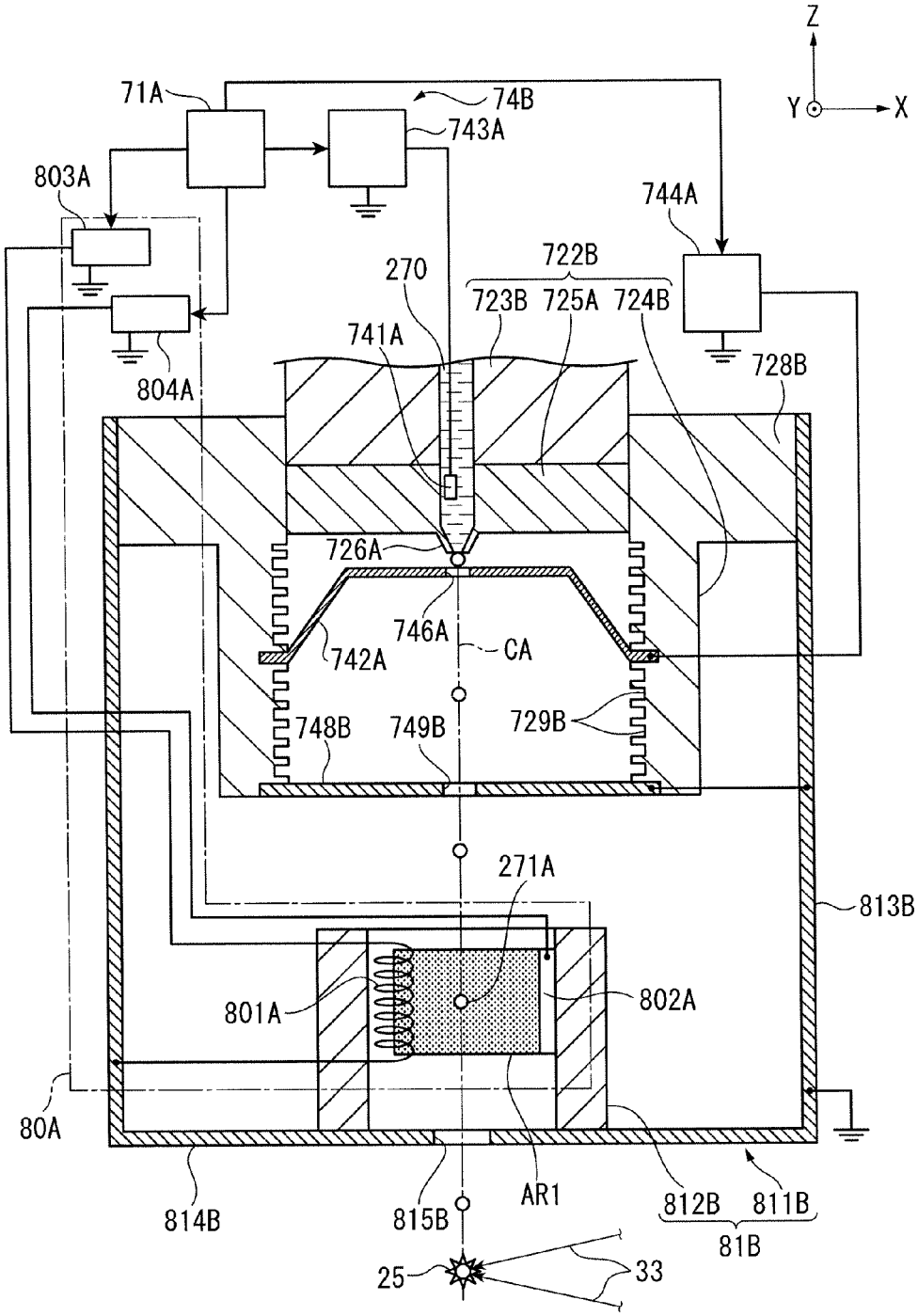
FIG. 5 schematically illustrates the configuration of a target supply device according to a second embodiment.

FIG. 5 schematically illustrates the configuration of the target supply device according to the second embodiment.

The target supply device according to the second embodiment may have the same configuration as the target supply device 7A according to the first embodiment, with the exception of a target generator, an electrostatic extraction section 74B, and a holder portion 81B.

A nozzle 722B of the target generator may include a nozzle main body 723B, a holding portion 724B, and the output portion 725A, as shown in FIG. 5.

The nozzle main body 723B may be formed in an approximately cylindrical shape. An outer diameter of the nozzle main body 723B may be substantially the same as an outer diameter of the output portion 725A.

The holding portion 724B may be formed in an approximately cylindrical shape. The holding portion 724B may be anchored to the nozzle main body 723B so that the nozzle main body 723B and the output portion 725A are fitted into a first end portion on the +Z direction side of the holding portion 724B. A protruding portion 728B that protrudes outward in a radial direction of the holding portion 724B may be provided on the first end portion side of the holding portion 724B. A plurality of grooves 729B may be provided in an inner circumferential surface of the holding portion 724B. The plurality of grooves 729B can suppress creeping discharge from the second electrode 742A and a third electrode 748B (mentioned later) held within the holding portion 724B.

The electrostatic extraction section 74B may include the third electrode 748B in addition to the elements of the electrostatic extraction section 74A according to the first embodiment.

The third electrode 748B may be formed as an approximately circular plate. A circular second through-hole 749B may be formed in the center of the third electrode 748B. The third electrode 748B may be anchored to a second end portion on the −Z direction side of the holding portion 724B. At this time, the third electrode 748B may be disposed between the second electrode 742A and the first region AR1. A center axis of the nozzle 722B may be positioned within the second through-hole 749B.

The holder portion 81B may include a first holder 811B and a second holder 812B.

The first holder 811B may be formed of a conductive material. The first holder 811B may have a cylindrical portion 813B and a disk portion 814B. The cylindrical portion 813B may be anchored to the holding portion 724B so that the protruding portion 728B fits into a first end portion on the +Z direction side of the cylindrical portion 813B. The disk portion 814B may be provided so as to cover a second end portion on the −Z direction side of the cylindrical portion 813B. A circular through-hole 815B may be provided in the center of the disk portion 814B. The center axis of the nozzle 722B may be positioned within the through-hole 815B.

The first holder 811B may be grounded. The third electrode 748B may be electrically connected to the first holder 811B. A potential at the third electrode 748B can be set to 0 V through the electrical connection between the first holder 811B and the third electrode 748B. In other words, the first holder 811B may serve as a third potential setting unit according to the present disclosure. A third potential according to the present disclosure may be 0 V.

The second holder 812B may be formed in a cylindrical shape of an insulative material, but the embodiment is not limited thereto, and the second holder 812B may have a quadrangular pipe shape instead. The second holder 812B may be anchored to a first surface on the +Z direction side of the disk portion 814B. A center axis of the second holder 812B may substantially match a center axis of the through-hole 815B. The thermoelectron emitting portion 801A and the thermoelectron collecting portion 802A may be anchored to an inner side of the second holder 812B. The second holder 812B may be disposed so that the set trajectory CA is located between the thermoelectron emitting portion 801A and the thermoelectron collecting portion 802A.

3.3.3 Operation

Next, operations of the target supply device will be described.

In the following, descriptions of operations identical to those in the first embodiment will be omitted.

With the target material 270 within the target generator in a melted state, the target control apparatus 71A may apply the positive first potential to each of the target material 270 and the second electrode 742A. The target control apparatus 71A may cause thermoelectrons to be produced in the first region AR1.

The target control apparatus 71A may extract the target 271A by controlling the potential applied to the second electrode 742A. The positively-charged target 271A can pass through the first through-hole 746A of the second electrode 742A. Due to a potential difference between the second potential at the second electrode 742A and the third potential at the third electrode 748B, the target 271A that has passed through the first through-hole 746A can accelerate and pass through the second through-hole 749B of the third electrode 748B.

The charge of the target 271A can be neutralized by the thermoelectrons in the first region AR1, and the charge amount thereof can be reduced. As a result, the repulsive force arising between the EUV collector mirror 23 and the target 271A can be lower than in the case illustrated in FIG. 4, and the trajectory of the target 271A can be suppressed from shifting from the set trajectory CA.

According to the second embodiment as described above, the target supply device can suppress the trajectory of the target 271A from shifting from the set trajectory CA, with the target 271A moving faster than in the first embodiment.

3.4 Third Embodiment 3.4.1 Overview

In a target supply device according to a third embodiment of the present disclosure, a polarity of the second potential may be different from a polarity of the third potential.

3.4.2 Configuration

Figure 6:
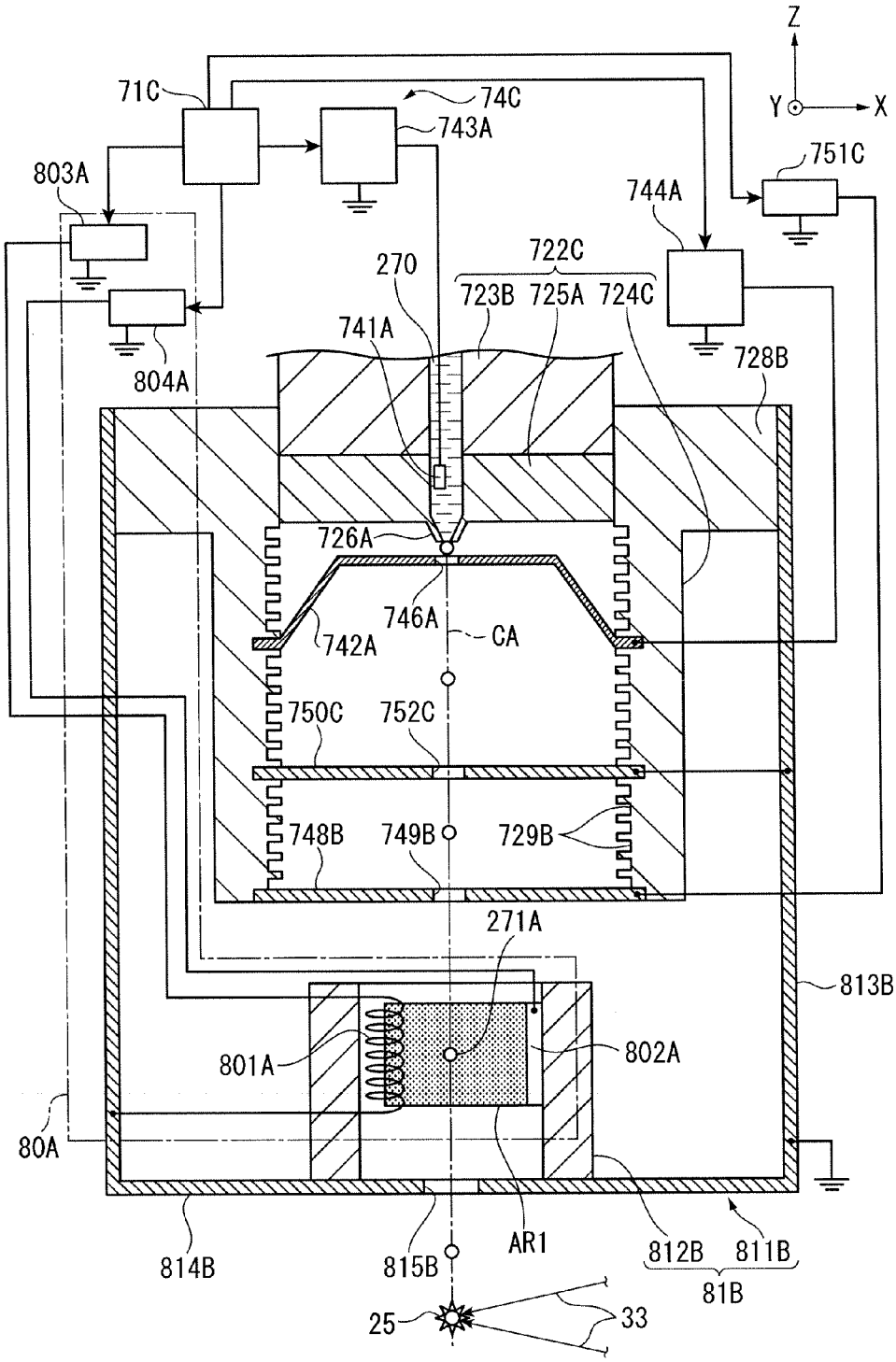
FIG. 6 schematically illustrates the configuration of a target supply device according to a third embodiment.

FIG. 6 schematically illustrates the configuration of the target supply device according to the third embodiment.

The target supply device according to the third embodiment may have the same configuration as the target supply device according to the second embodiment, with the exception of a target control apparatus 71C, a target generator, and an electrostatic extraction section 74C.

A nozzle 722C of the target generator may have the same configuration as the nozzle 722B according to the second embodiment with the exception of a holding portion 724C, as shown in FIG. 6.

The holding portion 724C may have a greater dimension in the Z-axis direction than the holding portion 724B according to the second embodiment.

The electrostatic extraction section 74C may include a fourth electrode 750C and a voltage source 751C in addition to the elements of the electrostatic extraction section 74B according to the second embodiment.

The fourth electrode 750C may have the same configuration as the third electrode 748B. The fourth electrode 750C may be anchored to the holding portion 724C between the second electrode 742A and the third electrode 748B. A center axis of the nozzle 722C may be positioned within a third through-hole 752C of the fourth electrode 750C. The fourth electrode 750C may be electrically connected to the first holder 811B. The potential of the fourth electrode 750C can be set to 0 V.

The voltage source 751C may serve as the third potential setting unit according to the present disclosure. The device ground of the voltage source 751C may be grounded. The third electrode 748B and the target control apparatus 71C may be electrically connected to the voltage source 751C.

The target control apparatus 71C may control a potential applied to the third electrode 748B by sending a signal to the voltage source 751C.

3.4.3 Operation

Next, operations of the target supply device will be described.

In the following, descriptions of operations identical to those in the second embodiment will be omitted.

The target control apparatus 71C may apply the positive first potential to each of the target material 270 and the second electrode 742A. The target control apparatus 71C may set the negative third potential to the third electrode 748B. The target control apparatus 71C may cause thermoelectrons to be produced in the first region AR1.

The target control apparatus 71C may extract the target 271A by controlling the potential applied to the second electrode 742A. The positively-charged target 271A can pass through the first through-hole 746A of the second electrode 742A. Due to a potential difference between the second potential at the second electrode 742A and a fourth potential at the fourth electrode 750C, the target 271A that has passed through the first through-hole 746A can accelerate between the second electrode 742A and the fourth electrode 750C and then pass through the third through-hole 752C of the fourth electrode 750C. Due to a potential difference between the fourth potential at the fourth electrode 750C and the third potential at the third electrode 748B, the target 271A that has passed through the third through-hole 752C can accelerate between the fourth electrode 750C and the third electrode 748B and then pass through the second through-hole 749B of the third electrode 748B.

The charge of the target 271A can be neutralized by the thermoelectrons in the first region AR1, and the charge amount thereof can be reduced. As a result, the repulsive force arising between the EUV collector mirror 23 and the target 271A can be lower than in the case illustrated in FIG. 4, and the trajectory of the target 271A can be suppressed from shifting from the set trajectory CA.

According to the third embodiment as described above, the target supply device can suppress the trajectory of the target 271A from shifting from the set trajectory CA, with the target 271A moving faster than in the second embodiment.

The third potential at the third electrode 748B may be a negative potential. In the case where the target supply device is not provided with the charge neutralization section 80A, the positively-charged target 271A can decelerate during the period from when the target 271A passes through the second through-hole 749B to when the target 271A reaches the plasma generation region 25.

According to the third embodiment, the charge neutralization section 80A reduces the charge amount of the target 271A, and thus the target 271A can be suppressed from decelerating during the period from when the target 271A passes through the second through-hole 749B to when the target 271A reaches the plasma generation region 25.

3.5 Fourth Embodiment 3.5.1 Overview

A target supply device according to a fourth embodiment of the present disclosure may include a deflection unit that produces a potential difference in a direction orthogonal to the center axis of the nozzle in a second region located between the second electrode and the first region.

3.5.2 Configuration

Figure 7:
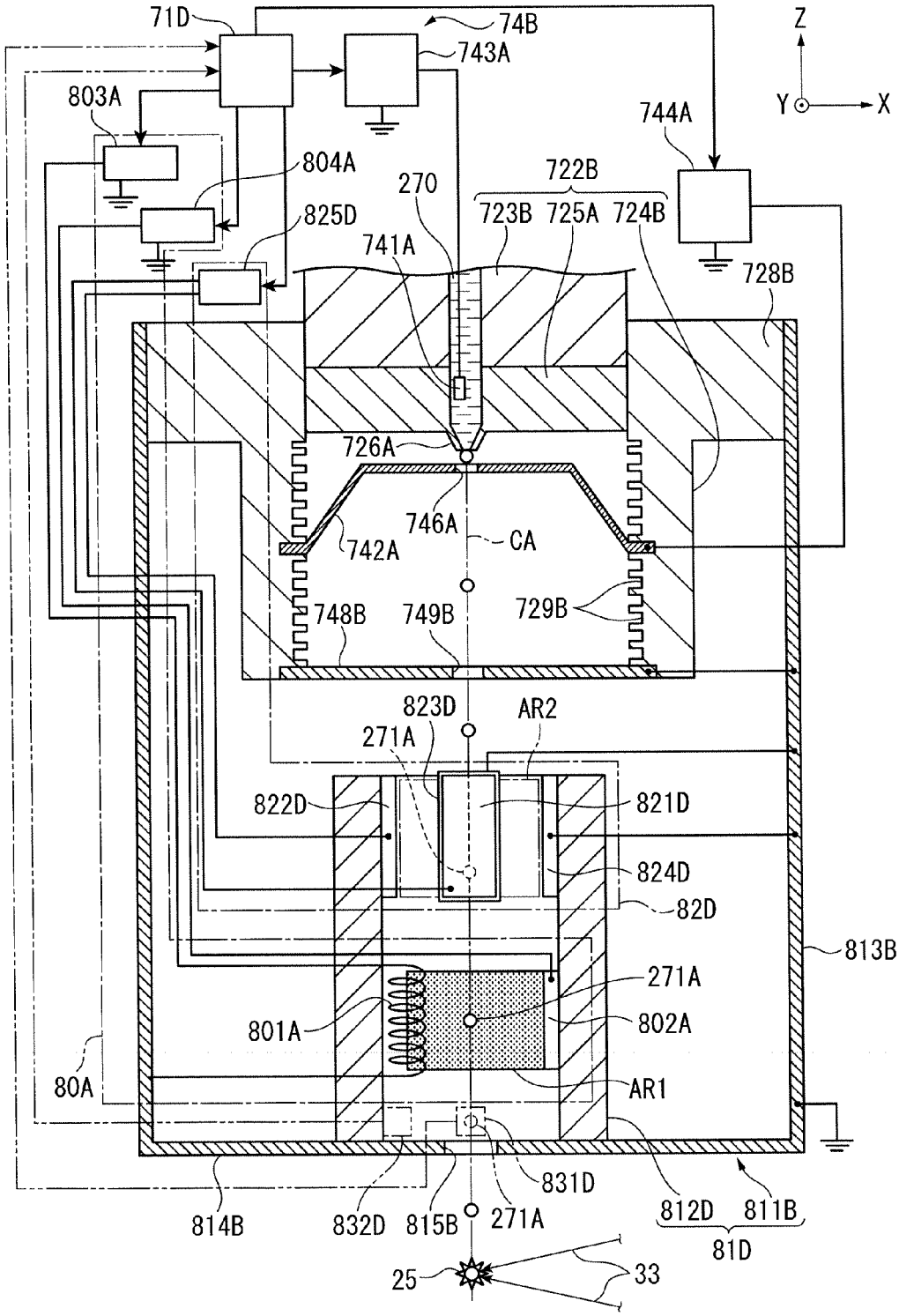
FIG. 7 schematically illustrates the configuration of a target supply device according to a fourth embodiment.

FIG. 7 schematically illustrates the configuration of the target supply device according to the fourth embodiment.

The target supply device may have the same configuration as the target supply device according to the second embodiment, with the exception of a target control apparatus 71D, a holder portion 81D, and a deflection section 82D, as shown in FIG. 7.

Aside from a second holder 812D having a greater dimension in the Z-axis direction than the second holder 812B according to the second embodiment, the holder portion 81D may have the same configuration as the holder portion 81B according to the second embodiment.

The deflection section 82D may include a first deflection electrode 821D, a second deflection electrode 822D, a third deflection electrode 823D, a fourth deflection electrode 824D, and a power source 825D.

The first to fourth deflection electrodes 821D to 824D may be provided on an inner circumferential surface of a first end portion in the +Z direction side of the second holder 812D. The first deflection electrode 821D may be provided on a first surface on the +Y direction side relative to the set trajectory CA. The second deflection electrode 822D may be provided on a second surface on the −X direction side relative to the set trajectory CA. The third deflection electrode 823D may be provided on a third surface that opposes the first surface. The fourth deflection electrode 824D may be provided on a fourth surface that opposes the second surface. A region surrounded by the first to fourth deflection electrodes 821D to 824D can serve as a second region AR2 located between the third electrode 748B and the first region AR1.

The first deflection electrode 821D and the second deflection electrode 822D may be electrically connected to the power source 825D. The third deflection electrode 823D and the fourth deflection electrode 824D may be electrically connected to the cylindrical portion 813B. Because the cylindrical portion 813B is grounded, a potential at the third deflection electrode 823D and a potential at the fourth deflection electrode 824D can both be 0 V.

The power source 825D may be electrically connected to the target control apparatus 71D.

The thermoelectron emitting portion 801A and the thermoelectron collecting portion 802A may be provided on the −Z direction side of the first to fourth deflection electrodes 821D to 824D.

The target control apparatus 71D may control potentials applied to the first deflection electrode 821D and the second deflection electrode 822D by sending signals to the power source 825D.

3.5.3 Operation

Next, operations of the target supply device will be described.

In the following, descriptions of operations identical to those in the second embodiment will be omitted.

The target control apparatus 71D may apply the positive first potential to each of the target material 270 and the second electrode 742A. The target control apparatus 71D may cause thermoelectrons to be produced in the first region AR1. The target control apparatus 71D may control the potentials applied to the first deflection electrode 821D and the second deflection electrode 822D individually by sending signals to the power source 825D. Potential differences can arise in the second region AR2 in both a Y-axis direction and an X-axis direction. These potential differences may be of a size at which the trajectory of the target 271A that has passed through the second through-hole 749B is corrected and the corrected trajectory substantially matches the set trajectory CA.

The target control apparatus 71D may extract the target 271A by controlling the potential applied to the second electrode 742A. The positively-charged target 271A can pass through the first through-hole 746A of the second electrode 742A and the second through-hole 749B of the third electrode 748B. When the target 271A enters the second region AR2, the trajectory can change depending on the potential difference. For example, in the case where a positive potential is being applied to the first deflection electrode 821D, the trajectory of the target 271A can change in the −Y direction. In the case where a negative potential is being applied to the first deflection electrode 821D, the trajectory of the target 271A can change in the +Y direction. In the case where a positive potential is being applied to the second deflection electrode 822D, the trajectory of the target 271A can change in the +X direction. In the case where a negative potential is being applied to the second deflection electrode 822D, the trajectory of the target 271A can change in the −X direction. An amount of change in the trajectory of the target 271A can correspond to the size of the potential difference.

Here, the potential difference in the second region AR2 may be determined in advance so that a shift between the trajectory of the target 271A when potentials are not being applied to the first deflection electrode 821D and the second deflection electrode 822D and the set trajectory CA is examined so as to substantially eliminate the shift.

Alternatively, the potential difference may be determined in real time through feedback control by monitoring the trajectory of the target 271A. To carry out feedback control, the EUV light generation apparatus 1 as shown in FIG. 1 may detect the trajectory of the target 271A using the target sensor 4 and control the potentials at the first deflection electrode 821D and the second deflection electrode 822D via the target control apparatus 71D. Alternatively, a first imaging unit 831D and a second imaging unit 832D may be provided within the second holder 812D on the −Z direction side of the first region AR1, as indicated by the double-dot-dash line in FIG. 7. The first imaging unit 831D may be provided on the third surface of the second holder 812D. The second imaging unit 832D may be provided on the second surface of the second holder 812D. The first imaging unit 831D and the second imaging unit 832D may be electrically connected to the target control apparatus 71D. The first imaging unit 831D and the second imaging unit 832D may capture images of the target 271A and send signals corresponding to the captured images to the target control apparatus 71D. The target control apparatus 71D may receive the signals from the first imaging unit 831D and the second imaging unit 832D, and may calculate a shift between the trajectory of the target 271A and the set trajectory CA. In the case where the trajectory of the targets 271A is shifted in the Y-axis direction relative to the set trajectory CA, the potential applied to the first deflection electrode 821D may be controlled in correspondence with the amount of the shift. In the case where the trajectory of the target 271A is shifted in the X-axis direction, the potential applied to the second deflection electrode 822D may be controlled in correspondence with the amount of the shift.

The charge of the target 271A whose trajectory has been corrected at the second region AR2 can be neutralized by the thermoelectrons in the first region AR1, and the charge amount thereof can be reduced. As a result, the repulsive force arising between the EUV collector mirror 23 and the target 271A can be lower than in the case illustrated in FIG. 4, and the trajectory of the target 271A can be suppressed from shifting from the set trajectory CA.

According to the fourth embodiment as described above, in the target supply device, the charge neutralization section 80A neutralizes the charge of the target 271A after the trajectory of the target 271A has been corrected by the deflection section 82D, and thus the trajectory of the targets 271A can be made more stable.

3.6 Fifth Embodiment 3.6.1 Overview

In a target supply device according to a fifth embodiment of the present disclosure, the charge neutralization unit may include an electron beam irradiating unit that emits an electron beam in the first region.

3.6.2 Configuration

Figure 8:
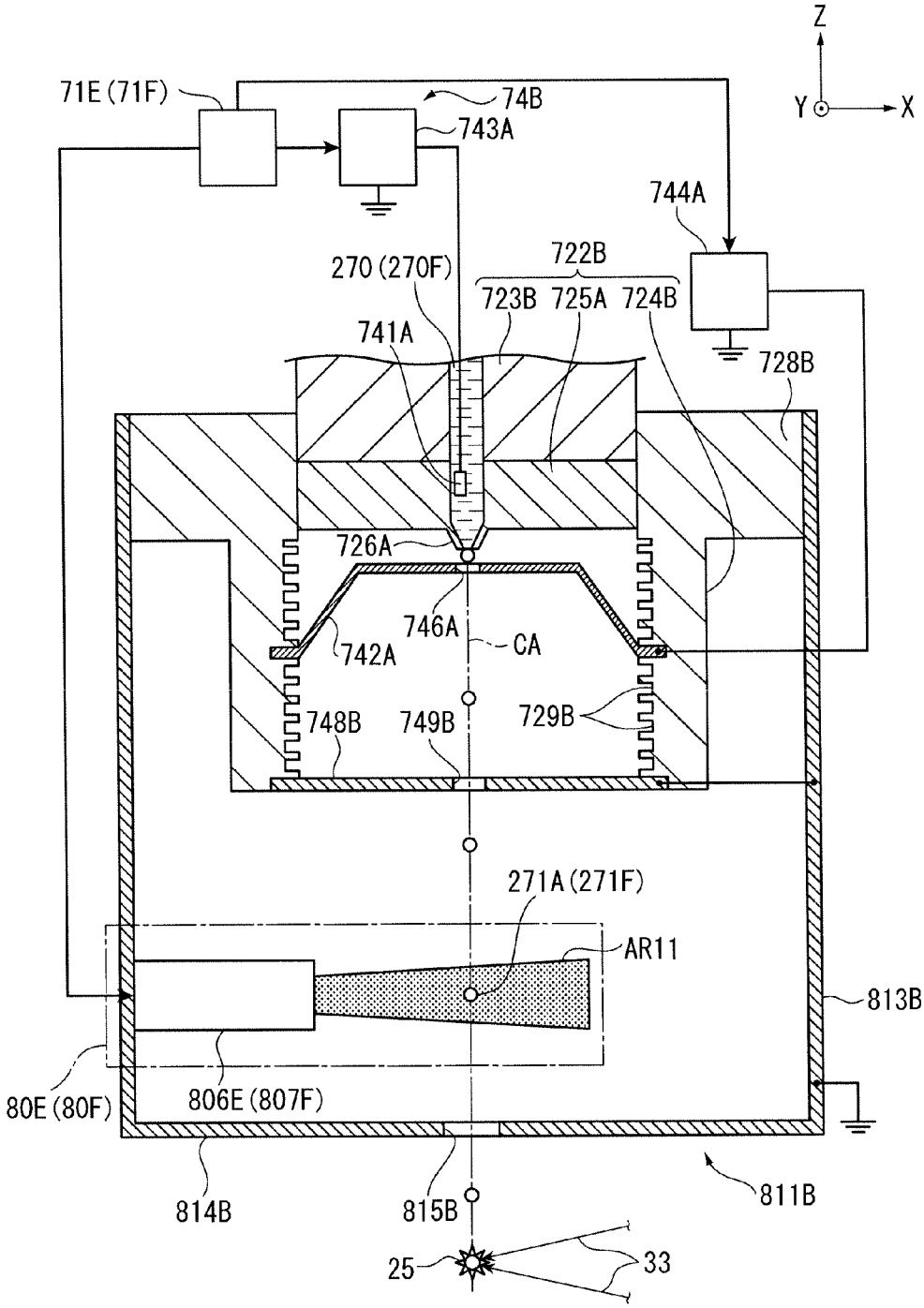
FIG. 8 schematically illustrates the configuration of a target supply device according to fifth and sixth embodiments.

FIG. 8 schematically illustrates the configuration of the target supply device according to the fifth and sixth embodiments.

The target supply device may have the same configuration as the target supply device according to the second embodiment, with the exception of a target control apparatus 71E and a charge neutralization section 80E, as shown in FIG. 8. Note that the configuration may be such that the second holder 812B is not provided in the target supply device according to the fifth embodiment.

The charge neutralization section 80E may include an electron beam irradiating unit 806E. The electron beam irradiating unit 806E may be anchored to the cylindrical portion 813B of the first holder 811B. The electron beam irradiating unit 806E may be electrically connected to the target control apparatus 71E.

The target control apparatus 71E may cause an electron beam to be emitted in a first region AR11 that contains the set trajectory CA by sending a signal to the electron beam irradiating unit 806E.

3.6.3 Operation

Next, operations of the target supply device will be described.

In the following, descriptions of operations identical to those in the second embodiment will be omitted.

The target control apparatus 71E may apply the positive first potential to each of the target material 270 and the second electrode 742A. The target control apparatus 71E may cause the electron beam to be emitted in the first region AR11 by sending a signal to the electron beam irradiating unit 806E.

The target control apparatus 71E may extract the target 271A by controlling the potential applied to the second electrode 742A. The positively-charged target 271A can pass through the first through-hole 746A of the second electrode 742A and the second through-hole 749B of the third electrode 748B. When the target 271A enters the first region AR11, the charge of the target 271A can be neutralized by the electron beam, and the charge amount thereof can be reduced. As a result, the repulsive force arising between the EUV collector mirror 23 and the target 271A can be lower than in the case illustrated in FIG. 4, and the trajectory of the target 271A can be suppressed from shifting from the set trajectory CA.

3.7 Sixth Embodiment 3.7.1 Overview

In a target supply device according to the sixth embodiment of the present disclosure, the charge neutralization unit may include an ion beam irradiating unit that emits an ion beam in the first region.

3.7.2 Configuration

The target supply device may have the same configuration as the target supply device according to the fifth embodiment, with the exception of a target control apparatus 71F and a charge neutralization section 80F, as shown in FIG. 8.

Target material 270F according to the sixth embodiment may be configured of a material that results in targets 271F being negatively charged. For example, the target material 270F may be xenon.

The charge neutralization section 80F may include an ion beam irradiating unit 807F. The ion beam irradiating unit 807F may be anchored to the cylindrical portion 813B. The ion beam irradiating unit 807F may be electrically connected to the target control apparatus 71F.

The target control apparatus 71F may cause an ion beam to be emitted in the first region AR11 by sending a signal to the ion beam irradiating unit 807F.

3.7.3 Operation

Next, operations of the target supply device will be described.

In the following, descriptions of operations identical to those in the second embodiment will be omitted.

The target control apparatus 71F may apply the negative first potential to each of the target material 270F and the second electrode 742A. The target control apparatus 71F may cause the ion beam to be emitted in the first region AR11 by sending a signal to the ion beam irradiating unit 807F.

The target control apparatus 71F may cause the potential applied to the second electrode 742A to rise from the first potential to the negative second potential, hold the second potential for a predetermined amount of time, and once again return the potential to the first potential. The second potential may be less than 0 V and greater than the first potential. At this time, the target material 270F can be extracted in a shape of a droplet using static electricity in synchronization with the timing at which the potential at the second electrode 742A rises. Because the first potential at the first electrode 741A and the second potential at the second electrode 742A are negative potentials, the target 271F is negatively charged and can pass through the first through-hole 746A of the second electrode 742A. Meanwhile, because the second potential at the second electrode 742A is lower than the third potential at the third electrode 748B, the target 271F that has passed through the first through-hole 746A can accelerate and pass through the second through-hole 749B.

When the target 271F enters the first region AR11, the charge of the target 271F can be neutralized by the ion beam, and the charge amount thereof can be reduced. As a result, the repulsive force arising between the EUV collector mirror 23 and the target 271F can be lower than in the case illustrated in FIG. 4, and the trajectory of the target 271F can be suppressed from shifting from the set trajectory CA.

3.8 Seventh Embodiment 3.8.1 Configuration

Figure 9:
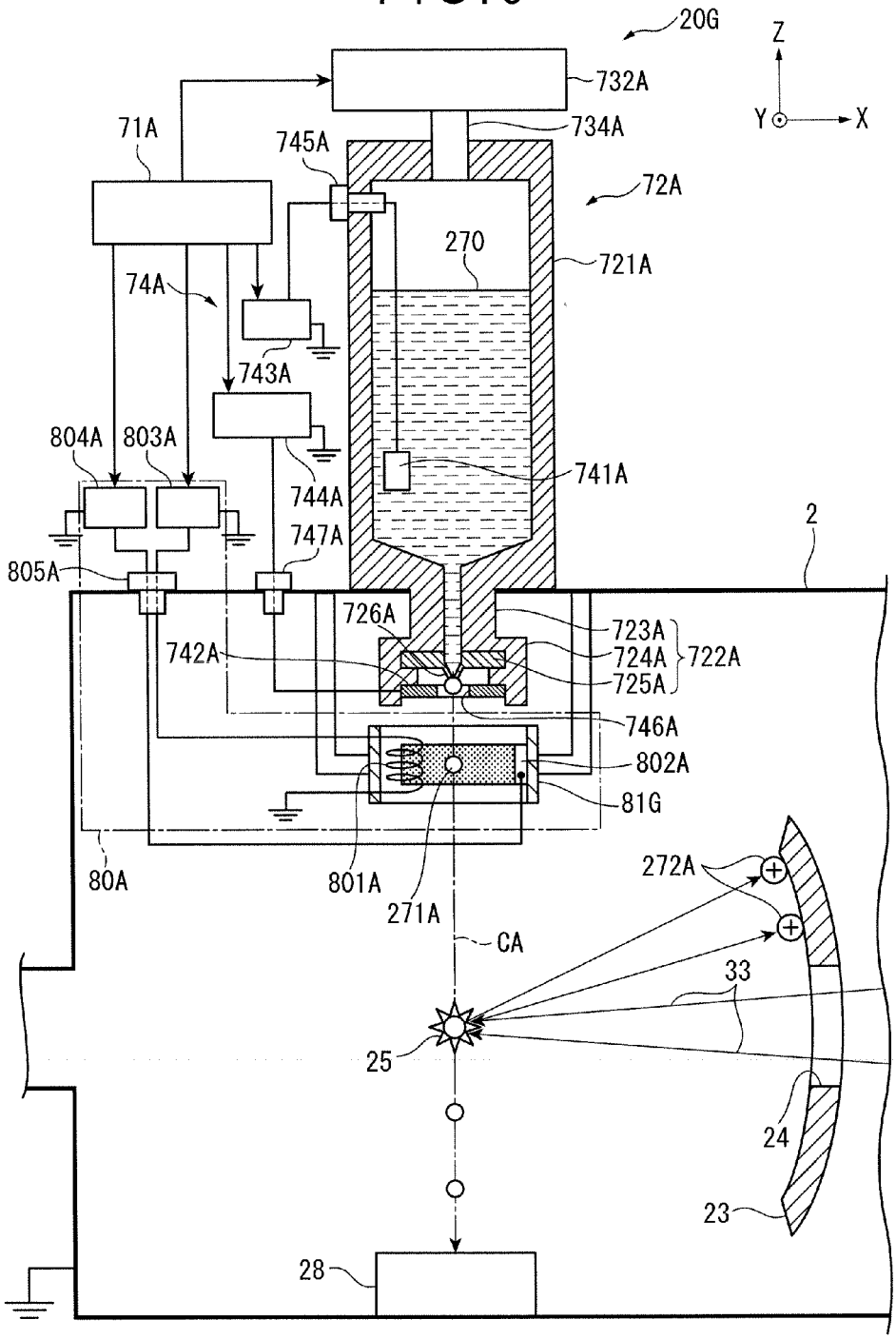
FIG. 9 schematically illustrates the configuration of an EUV light generation chamber according to a seventh embodiment.

FIG. 9 schematically illustrates the configuration of an EUV light generation chamber according to a seventh embodiment. Note that the operations of the EUV light generation chamber are the same as in the target supply device according to the first embodiment, and thus descriptions thereof will be omitted.

An EUV light generation chamber 20G may include the chamber 2, the target generator 72A, the first electrode 741A, the second electrode 742A, the charge neutralization section 80A, and a holder portion 81G, as shown in FIG. 9.

The holder portion 81G may be configured so as to anchor the thermoelectron emitting portion 801A and the thermoelectron collecting portion 802A to the chamber 2. The thermoelectron emitting portion 801A and the thermoelectron collecting portion 802A may be disposed in the same positions as in the first embodiment.

3.9 Eighth Embodiment 3.9.1 Configuration

Figure 10:
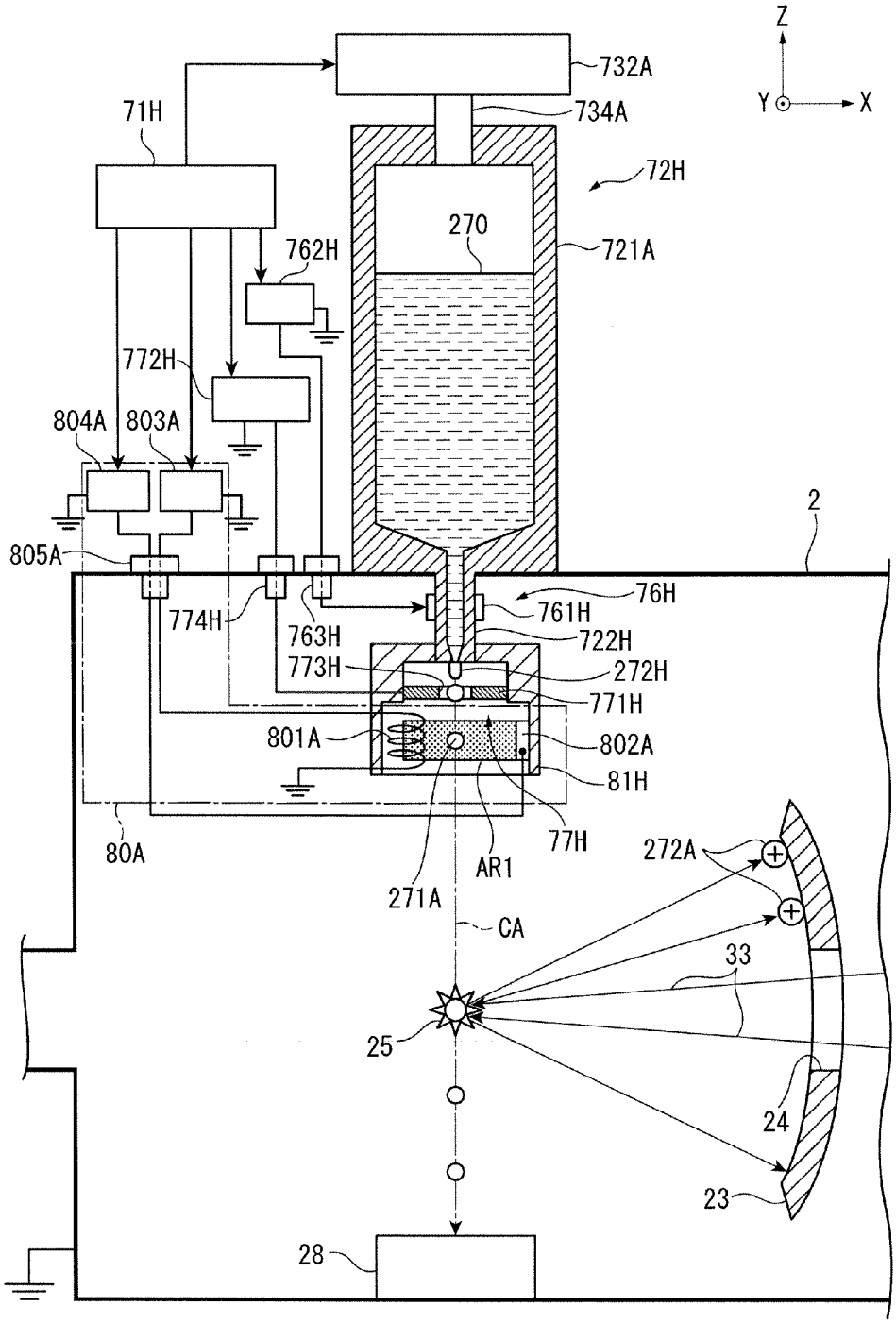
FIG. 10 schematically illustrates the configuration of a target supply device according to an eighth embodiment.

FIG. 10 schematically illustrates the configuration of a target supply device according to an eighth embodiment.

The target supply device may have the same configuration as the target supply device according to the first embodiment, with the exception of a target control apparatus 71H, a target generator 72H, and a holder portion 81H, as shown in FIG. 10. Meanwhile, the target supply device may include a piezoelectric section 76H and a charging section 77H instead of the electrostatic extraction section 74A.

The target generator 72H may include the tank 721A and a nozzle 722H. The nozzle 722H may be formed having a cylindrical shape.

The piezoelectric section 76H may include a piezoelectric element 761H and a power source 762H. The piezoelectric element 761H may be provided within the chamber 2 and on an outer circumferential surface of the nozzle 722H. Instead of the piezoelectric element 761H, a mechanism capable of applying vibrations to the nozzle 722H at a high rate may be provided. The power source 762H may be electrically connected to the piezoelectric element 761H via a feedthrough 763H. The power source 762H may be electrically connected to the target control apparatus 71H.

The charging section 77H may include a charging electrode 771H and a power source 772H. A through-hole 773H may be formed in the center of the charging electrode 771H. The charging electrode 771H may be held by the holder portion 81H so that a center axis of the nozzle 722H is located within the through-hole 773H. The power source 772H may be electrically connected to the charging electrode 771H via a feedthrough 774H. The power source 772H may be electrically connected to the target control apparatus 71H.

The holder portion 81H may anchor the charging electrode 771H, the thermoelectron emitting portion 801A, and the thermoelectron collecting portion 802A to the nozzle 722H.

The target control apparatus 71H may be configured to generate a jet 272H using a continuous jet method by sending signals to the power source 762H and the power source 772H and generate the targets 271A by causing the jet 272H outputted from the nozzle 722H to vibrate.

3.9.2 Operation

Next, operations of the target supply device will be described.

In the following, descriptions of operations identical to those in the first embodiment will be omitted.

The target control apparatus 71H may cause thermoelectrons to be produced in the first region AR1. The target control apparatus 71H may apply a positive potential to the charging electrode 771H. The target control apparatus 71H may melt the target material 270. The target control apparatus 71H may increase a pressure within the target generator 72H to a predetermined pressure in order to output the jet 272H. When the pressure within the target generator 72H reaches the predetermined pressure, the jet 272H can be outputted from the nozzle 722H.

The target control apparatus 71H may cause the piezoelectric element 761H to vibrate at a high rate. Through this, the jet 272H is interrupted at a constant cycle, and is thus outputted as the targets 271A. The target 271A can be positively charged upon passing through the through-hole 773H. The positively charged target 271A can be neutralized by the thermoelectrons in the first region AR1, and the charge amount thereof can be reduced.

3.10 Variations

Note that the following configurations may be employed as the target supply device and the EUV light generation chamber.

For example, an electrode and an ultraviolet light irradiation unit may be provided as the thermoelectron emitting portion 801A. The ultraviolet light irradiation unit may irradiate the electrode with ultraviolet light having an energy level greater than or equal to the work function of the electrode, emitting thermoelectrons as a result.

In the third embodiment, the fourth electrode 750C may be omitted.

The above-described embodiments and the modifications thereof are merely examples for implementing the present disclosure, and the present disclosure is not limited thereto. Making various modifications according to the specifications or the like is within the scope of the present disclosure, and other various embodiments are possible within the scope of the present disclosure. For example, the modifications illustrated for particular ones of the embodiments can be applied to other embodiments as well (including the other embodiments described herein).

The terms used in this specification and the appended claims should be interpreted as "non-limiting." For example, the terms "include" and "be included" should be interpreted as "including the stated elements but not limited to the stated elements." The term "have" should be interpreted as "having the stated elements but not limited to the stated elements." Further, the modifier "one (a/an)" should be interpreted as "at least one" or "one or more."

What is claimed is:

1. A target supply device that supplies a droplet of a target material to a plasma generation region, the device comprising:

a target generator comprising:

a tank containing the target material;

a nozzle from which the droplet is supplied toward the plasma generation region;

a first electrode disposed within the tank;

a second electrode provided with a first through-hole and disposed so that a center axis of the nozzle is positioned within the first through-hole;

a first potential setting unit configured to set a potential at the first electrode to a first potential; and a second potential setting unit configured to set a potential at the second electrode to a second potential that is different from the first potential, the droplet being charged and extracted from the nozzle due to a difference between the first potential and the second potential, and passing through the first through-hole of the second electrode, wherein the target generator further comprises a charge neutralization unit configured to neutralize the charged droplet at a first region immediately before the droplet is outputted from the target generator to the plasma generation region.

2. The target supply device according to claim 1, further comprising:

a deflection unit configured to produce a potential difference in a direction orthogonal to the center axis of the nozzle in a second region located between the second electrode and the first region.

3. The target supply device according to claim 1, further comprising:

a third electrode provided with a second through-hole and disposed between the second electrode and the first region so that the center axis of the nozzle is positioned within the second through-hole; and a third potential setting unit configured to set a potential at the third electrode to a third potential that is different from the first potential and the second potential, wherein the second potential is greater than the first potential and less than the third potential.

4. The target supply device according to claim 3, wherein a polarity of the second potential is different from a polarity of the third potential.

5. The target supply device according to claim 1, wherein the charge neutralization unit includes:

a thermoelectron emitting unit configured to emit thermoelectrons in the first region; and a thermoelectron collecting unit disposed opposing the thermoelectron emitting unit with the center axis of the nozzle between the thermoelectron collecting unit and the thermoelectron emitting unit and configured to collect the thermoelectrons.

6. The target supply device according to claim 1, wherein the charge neutralization unit includes:

an electron beam irradiating unit configured to emit an electron beam in the first region.

7. An EUV light generation chamber for irradiating a droplet of a target material supplied to a plasma generation region with a laser beam, the EUV light generation chamber comprising:

a chamber including an introduction hole that introduces the laser beam; and a target generator comprising:

a tank, containing the target material;

a nozzle, disposed to the chamber so that the nozzle is positioned within the chamber to supply the droplet toward the plasma generation region;

a first electrode disposed within the tank, the first electrode having a first potential; and a second electrode provided with a first through-hole and disposed so that a center axis of the nozzle is positioned within the first through-hole, the second electrode having a second potential, the droplet being charged and extracted from the nozzle due to a difference between the first potential and the second potential, and passing through the first through-hole of the second electrode; and a charge neutralization unit configured to neutralize the charged droplet at a first region immediately before the droplet is outputted from the target generator to the plasma generation region.

8. A target supply device that supplies a droplet of a target material to a plasma generation region, the device comprising:

a tank containing the target material and including a nozzle from which the droplet is supplied toward the plasma generation region;

a first electrode disposed within the tank;

a first potential setting unit configured to set a potential at the first electrode to a first potential;

a second electrode provided with a first through-hole and disposed so that a center axis of the nozzle is positioned within the first through-hole;

a second potential setting unit configured to set a potential at the second electrode to a second potential that is different from the first potential, the droplet being charged and extracted from the nozzle due to a difference between the first potential and the second potential, and passing through the first through-hole of the second electrode; and a charge neutralization unit configured to neutralize the charged droplet that passes through a first region between the second electrode and the plasma generation region, the charge neutralization unit including an ion beam irradiating unit configured to emit an ion beam to the first region.

9. The target supply device according to claim 8, further comprising:

a deflection unit configured to produce a potential difference in a direction orthogonal to the center axis of the nozzle in a second region located between the second electrode and the first region.

10. The target supply device according to claim 8, further comprising:

a third electrode provided with a second through-hole and disposed between the second electrode and the first region so that the center axis of the nozzle is positioned within the second through-hole; and a third potential setting unit configured to set a potential at the third electrode to a third potential that is different from the first potential and the second potential, wherein the second potential is greater than the first potential and less than the third potential.

11. The target supply device according to claim 10, wherein a polarity of the second potential is different from a polarity of the third potential.

* * * * *